US009132979B1

(12) United States Patent
Moore et al.

(10) Patent No.: US 9,132,979 B1
(45) Date of Patent: Sep. 15, 2015

(54) SHUTTLING NIP SET FOR MEDIA SHEET INVERSION

(71) Applicant: Xerox Corporation, Norwalk, CT (US)

(72) Inventors: Aaron M. Moore, Fairport, NY (US); Carlos M. Terrero, Ontario, NY (US); Timothy G. Shelhart, West Henrietta, NY (US); Roberto A. Irizarry, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/270,866

(22) Filed: May 6, 2014

(51) Int. Cl.
*B65H 5/06* (2006.01)
*B65H 15/00* (2006.01)

(52) U.S. Cl.
CPC ..... *B65H 15/00* (2013.01); *B65H 5/062* (2013.01); *B65H 2301/33312* (2013.01); *B65H 2301/34112* (2013.01); *B65H 2404/14211* (2013.01); *B65H 2404/1521* (2013.01); *B65H 2404/1522* (2013.01)

(58) Field of Classification Search
CPC ..... B65H 15/00; B65H 2301/34112; B65H 2301/333; B65H 2301/33214; B65H 2301/33224; B65H 2301/3331; B65H 2301/33312; B65H 2404/142; B65H 2404/1421; B65H 2404/14211; B65H 2404/1521; B65H 2404/1522; B65H 2404/1423; B65H 5/062
USPC ..... 271/272
See application file for complete search history.

(56) References Cited

U.S. PATENT DOCUMENTS

| | | | | |
|---|---|---|---|---|
| 5,201,517 | A * | 4/1993 | Stemmle | 271/291 |
| 5,215,298 | A * | 6/1993 | Stemmle et al. | 271/65 |
| 8,336,877 | B2 * | 12/2012 | Yamamoto et al. | 271/207 |
| 8,433,208 | B2 * | 4/2013 | Nanayama | 399/10 |
| 8,579,287 | B1 * | 11/2013 | Herrmann et al. | 271/302 |
| 8,714,545 | B2 * | 5/2014 | Huang et al. | 271/186 |
| 8,862,047 | B2 * | 10/2014 | Furushige et al. | 399/406 |
| 2008/0073837 | A1 * | 3/2008 | DeGruchy | 271/273 |
| 2008/0143044 | A1 * | 6/2008 | Hatano | 271/225 |
| 2013/0200564 | A1 * | 8/2013 | Choi et al. | 271/225 |

FOREIGN PATENT DOCUMENTS

DE 4431800 A1 * 3/1996

* cited by examiner

*Primary Examiner* — Patrick Cicchino
(74) *Attorney, Agent, or Firm* — Hoffmann & Baron, LLP

(57) ABSTRACT

A shuttling nip set sheet inverter is for use with a digital printing system. A shuttle nip selectively rotates in a forward or reverse direction. The shuttle nip rollers are mounted for mutual revolving orbit about an orbital axis. The shuttle nip rollers are also mounted for mutual translation in the process direction. An inversion nip is disposed adjacent a main nip and downstream from the shuttle nip. A diverter gate has a first end adjacent the shuttle nip and a second end adjacent the inversion nip. In duplex operation, the media sheet lead edge will pass through the shuttle nip. The shuttle nip will revolve orbitally and translate downstream. The trail edge will become the lead edge, inverting the media sheet, which enters the main nip. The diverter gate moves from an inversion position to a storage position away from the process path.

19 Claims, 13 Drawing Sheets

SHUTTLING NIP SET FOR MEDIA SHEET INVERSION

INCORPORATION BY REFERENCE

Not applicable.

TECHNICAL FIELD

This invention relates to inverting media sheets in digital printing machines, and, more particularly, to an apparatus, system, and method for inverting media sheets in a digital printing machine by revolving a nip set.

BACKGROUND

Digital printing machines can take on a variety of configurations. One common process is that of electrostatographic printing, which is carried out by exposing a light image of an original document to a uniformly charged photoreceptive member to discharge selected areas. A charged developing material is deposited to develop a visible image. The developing material is transferred to a medium sheet (paper) and heat fixed.

Another common process is that of direct to paper ink jet printing systems. In ink jet printing, tiny droplets of ink are sprayed onto the paper in a controlled manner to form the image. Other processes are well known to those skilled in the art. The primary output product for a typical digital printing system is a printed copy substrate such as a sheet of paper bearing printed information in a specified format.

The output sheet can be printed on one side only, known as simplex, or on both sides of the sheet, known as duplex printing. In order to duplex print, the sheet is fed through a marking engine to print on the first side, then the sheet is inverted and fed through the marking engine a second time to print on the reverse side. The apparatus that turns the sheet over is called an inverter.

FIG. 1 (prior art) shows a state-of-the-art digital printing machine 20. Printer 20 includes a marking engine 22, a media sheet feeder 24, and a finisher 26. Printer 20 has an inverter 28 to turn the sheet over for duplex printing. A second inverter 30 turns the sheet over again, so that the first side is facing up. Notice that the second inverter 30 has an optional bypass 32.

A commonly employed inverter 28 is shown in FIG. 2. Sheets following a prior art inversion path 49 enter at a sheet entry 34, travel downward through leg 35, nips 36 and 38 into a holding portion 40. The nip 38 then reverses, sending the sheet through nip 42 to the opposite leg 44, and out the sheet exit 46 onto the process path 48. The sheet is inverted, and the trail edge becomes the lead edge. Inverter 28 takes a considerable volume of space within the printer, because the legs 35, 44 must be of a minimum radius to avoid marking or creasing the sheets. Because the legs are sheet material such as metal, the paper slides across the surface of the metal, creating marks. This construction also tends to limit the speed at which sheets can be conveyed through inverter 28.

Accordingly, there is a need to provide a sheet inverting system that will occupy a minimum of volume within a printer.

There is a further need to provide a sheet inverting system of the type described and that will match the high production rate of a digital printing machine.

There is a still further need to provide a sheet inverting system of the type described and that is capable of selective simplex and duplex operation.

There is a yet further need to provide a sheet inverting system of the type described and that is mechanically simple and robust, thereby minimizing cost and avoiding the problems associated with the prior art.

SUMMARY

In one aspect, a shuttling nip set sheet inverter is for use in connection with a digital printing system and a media sheet moving along a process path in a process direction. The shuttling nip set sheet inverter comprises a shuttle nip having a first shuttle nip roller and a second shuttle nip roller. The first and second shuttle nip rollers are adapted for selective rotation in a forward direction and in a reverse direction. The first and second shuttle nip rollers are mounted for mutual revolving orbit about an orbital axis. The first and second shuttle nip rollers are mounted for mutual generally translational movement in the process direction from a starting position to an ending position.

A main nip is spaced apart from the shuttle nip a predetermined distance in the process direction. An inversion nip is disposed adjacent the main nip.

A diverter gate extends between opposite first and second ends. The diverter gate is adapted for movement from an inversion position to a storage position. In the inversion position, the first end is adjacent the shuttle nip and the second end is adjacent the inversion nip. The storage position is away from the process path.

In duplex operation, the media sheet lead edge will pass through the shuttle nip. The shuttle nip will revolve orbitally and translate downstream. The trail edge will become the lead edge, inverting the media sheet.

In another aspect, a shuttling nip set sheet inverter is for use in connection with a digital printing system and a media sheet moving along a process path in a process direction. The shuttling nip set sheet inverter comprises a shuttle nip having a first shuttle nip roller and a second shuttle nip roller held in mutual engagement. The first and second shuttle nip rollers are adapted for selective rotation in a forward direction and in a reverse direction. The first and second shuttle nip rollers are mounted for mutual revolving orbit about an orbital axis. The first and second shuttle nip rollers are mounted for mutual generally translational movement in the process direction from a starting position to an ending position. An entry guide is aligned with the shuttle nip to guide the media sheet along the process path to the shuttle nip. The entry guide has an opposed pair of entry guide plates spaced apart on opposite sides of the process path.

A main nip is spaced apart from the shuttle nip a predetermined distance in the process direction. A main guide is aligned with the main nip and generally aligned with the entry guide in the process direction. The main guide is provided to guide the media sheet along the process path to the main nip. The main guide has an opposed pair of main guide plates spaced apart on opposite sides of the process path.

A main funnel is provided having two funnel plates. Each funnel plate is attached to an end of one of the main guide plates. The two funnel plates have upstream ends diverging away from one another to guide the media sheet into the main guide.

An inversion nip is provided adjacent the main nip. The inversion nip is adapted for selective rotation in a forward direction and in a reverse direction. An inversion guide is aligned with the inversion nip and disposed adjacent the main guide. The inversion guide is provided to guide the media sheet along an inversion path to the inversion nip. The inversion guide has an opposed pair of inversion guide plates spaced apart on opposite sides of the inversion path.

An inversion funnel is provided having at least one funnel plate attached to an end of one of the inversion guide plates. The funnel plate has an upstream end diverging away from the opposite inversion guide plate to guide the media sheet into the inversion guide.

A diverter gate extends between opposite first and second ends. The diverter gate is adapted for movement from an inversion position to a storage position. In the inversion position the first end is juxtaposed with the process path adjacent the shuttle nip and the second end is juxtaposed with the inversion path adjacent the inversion nip. The storage position is away from the process path.

In duplex operation, the media sheet lead edge will pass through the shuttle nip and travel up the diverter gate into the inversion nip, the shuttle nip will revolve orbitally and translate downstream, the shuttle nip and the main nip will reverse rotation, the trail edge will become the lead edge thereby inverting the media sheet, and the media sheet will enter the main guide and pass through the main nip.

In yet another aspect, a method for inverting a media sheet is for use in connection with a digital printing system and a media sheet. The method comprises feeding the media sheet into a shuttle nip having a first shuttle nip roller and a second shuttle nip roller. The first and second shuttle nip rollers are rotated in a forward direction.

A lead edge of the media sheet is guided along a diverter gate into an inversion nip. The inversion nip is rotated in a forward direction. The diverter gate is moved to a storage position away from the process path.

The first and second shuttle nip rollers revolve mutually about an orbital axis. A trail edge of the media sheet is redirected into a downstream direction toward a main nip. The rotation of the shuttle nip is then reversed. The trail edge is allowed to become a new lead edge, thereby inverting the media sheet.

The first and second shuttle nip rollers translate mutually in a generally downstream process direction from a starting position to an ending position. The inversion nip is rotated in a reverse direction. The media sheet is then guided into the main nip for duplex operation.

These and other aspects, objectives, features, and advantages of the disclosed technologies will become apparent from the following detailed description of illustrative embodiments thereof, which is to be read in connection with the accompanying drawings.

DETAILED DESCRIPTION

Describing now in further detail these exemplary embodiments with reference to the Figures as described above, the shuttling nip set sheet inverter is typically used in a select location or locations of the paper path or paths of various conventional media handling assemblies. Thus, only a portion of an exemplary media handling assembly path is illustrated herein. It should be noted that the drawings herein are not to scale.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" or "media sheet" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" or "lead edge" (LE) of a media substrate refers to an edge of the sheet that is furthest downstream in the process direction.

As used herein, a "media handling assembly" refers to one or more devices used for handling and/or transporting media substrate, including feeding, printing, finishing, registration and transport systems.

As used herein, the terms "process" and "process direction" refer to a procedure of moving, transporting and/or handling a substrate media sheet. The process direction is a flow path the sheet moves in during the process.

Figure 1:
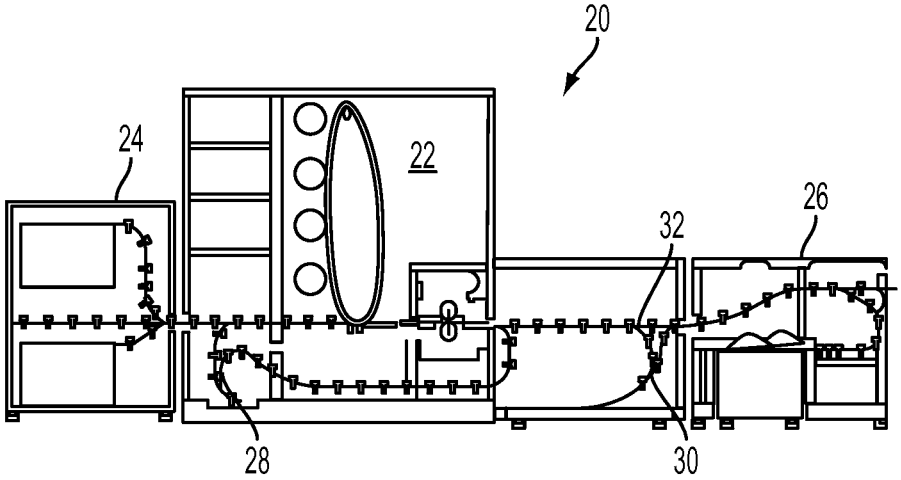
FIG. 1 PRIOR ART
FIG. 1 is a schematic side elevational, sectional view of an exemplary production printer showing a prior art inverter.
Figure 2:
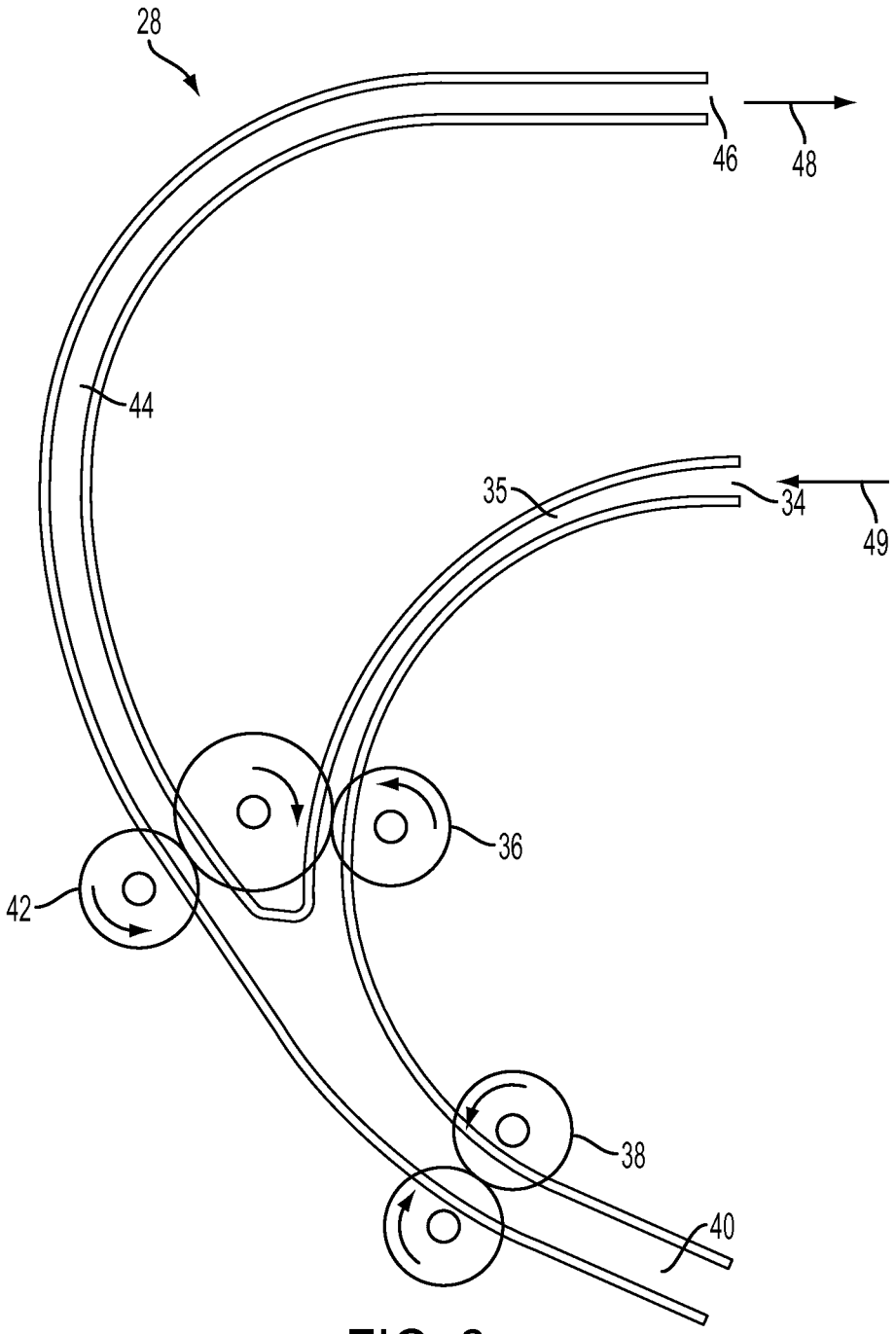
FIG. 2 PRIOR ART
FIG. 2 is a schematic side elevational, sectional enlarged view of the prior art inverter of FIG. 1.
Figure 3:
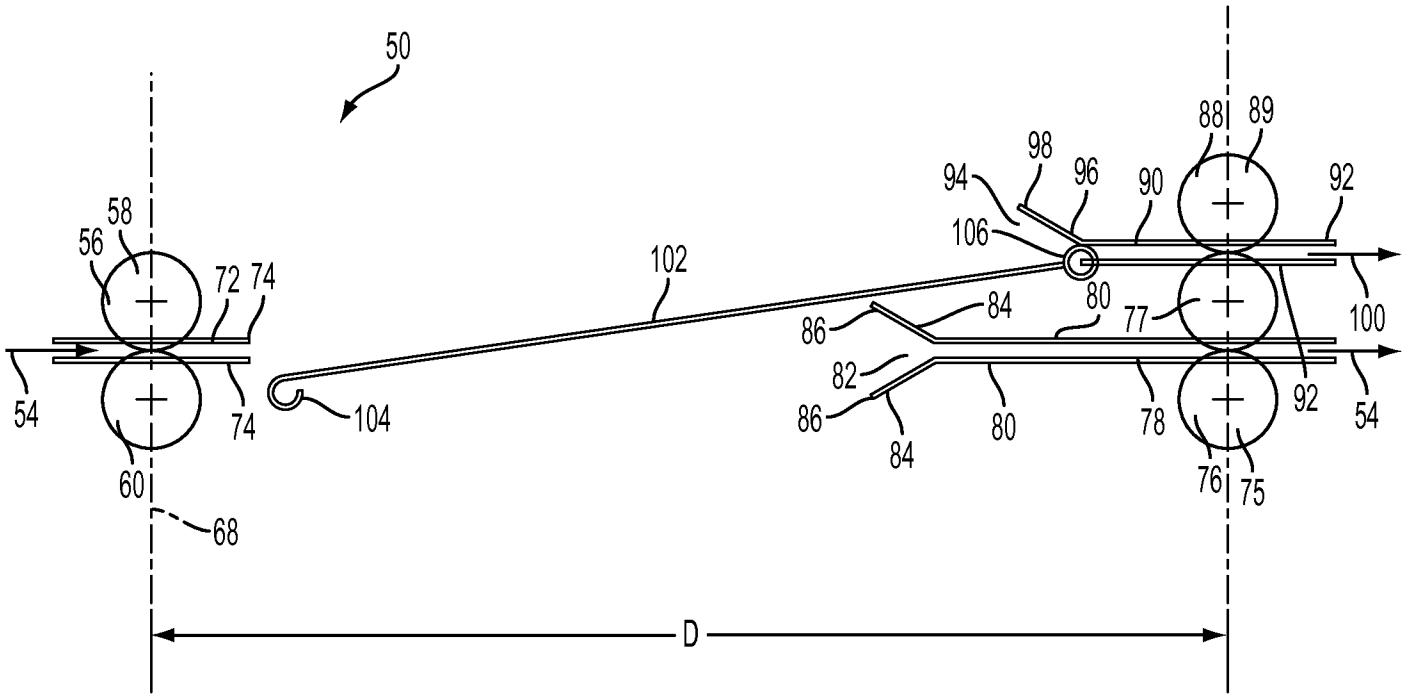
FIG. 3 is a schematic side elevational, sectional view of a shuttling nip set sheet inverter constructed in accordance with the invention, showing the diverter gate in duplex position.
Figure 4:
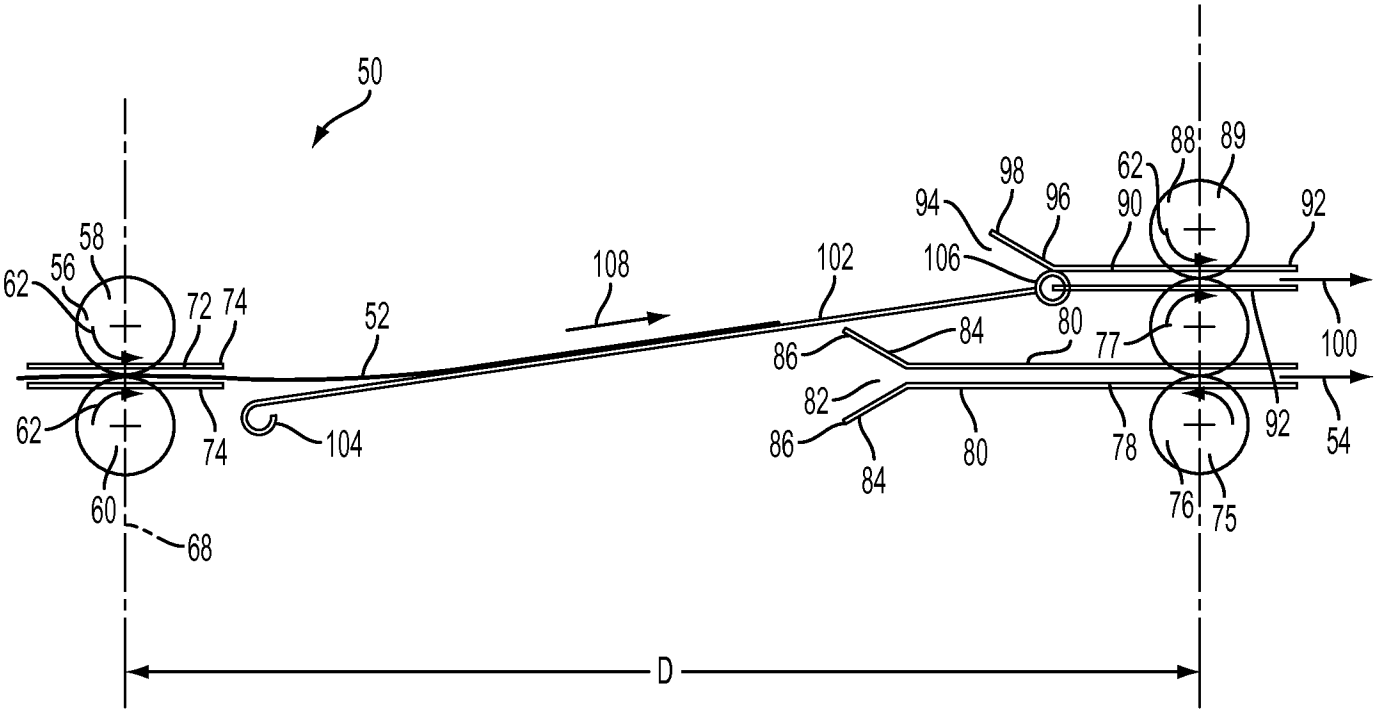
FIG. 4 is a schematic side elevational, sectional view of the shuttling nip set of FIG. 3, showing a sheet entering the diverter gate in duplex operation.
Figure 5:
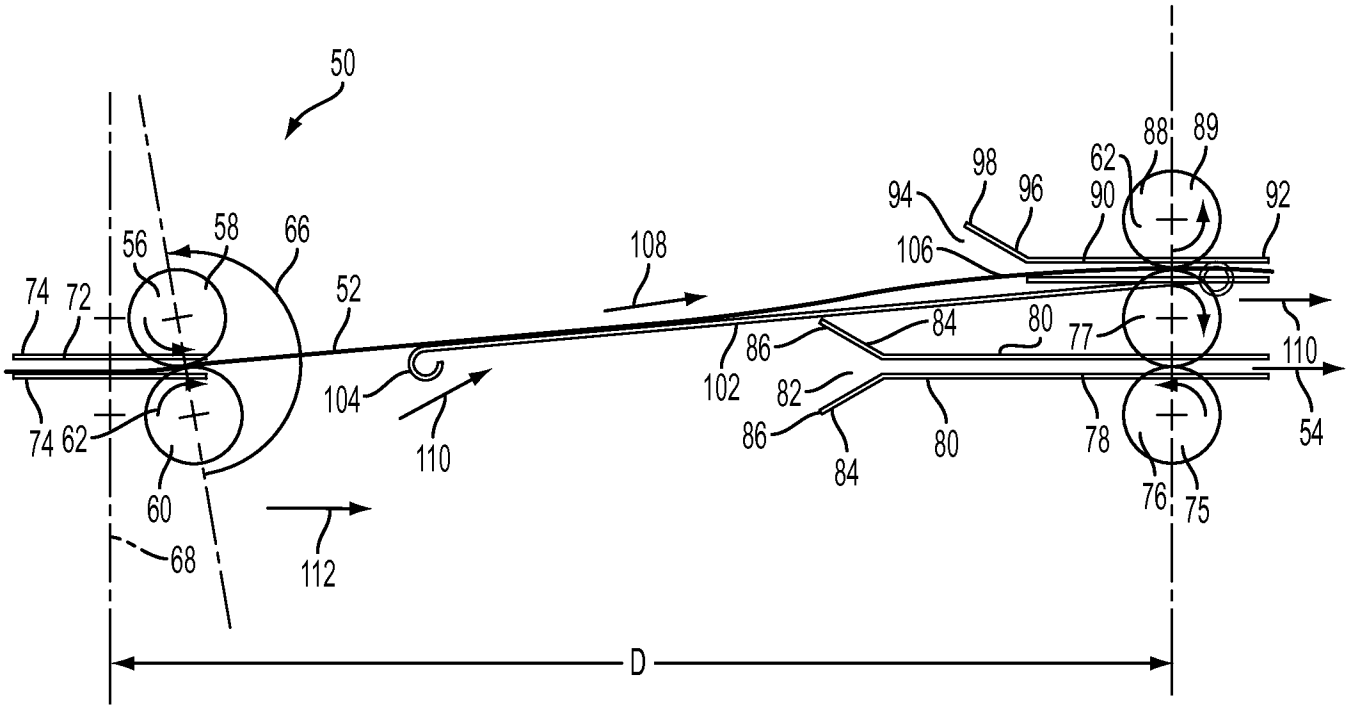
FIG. 5 is a schematic side elevational, sectional view of the shuttling nip set of FIG. 3, showing the sheet entering an inversion path in duplex operation.
Figure 6:
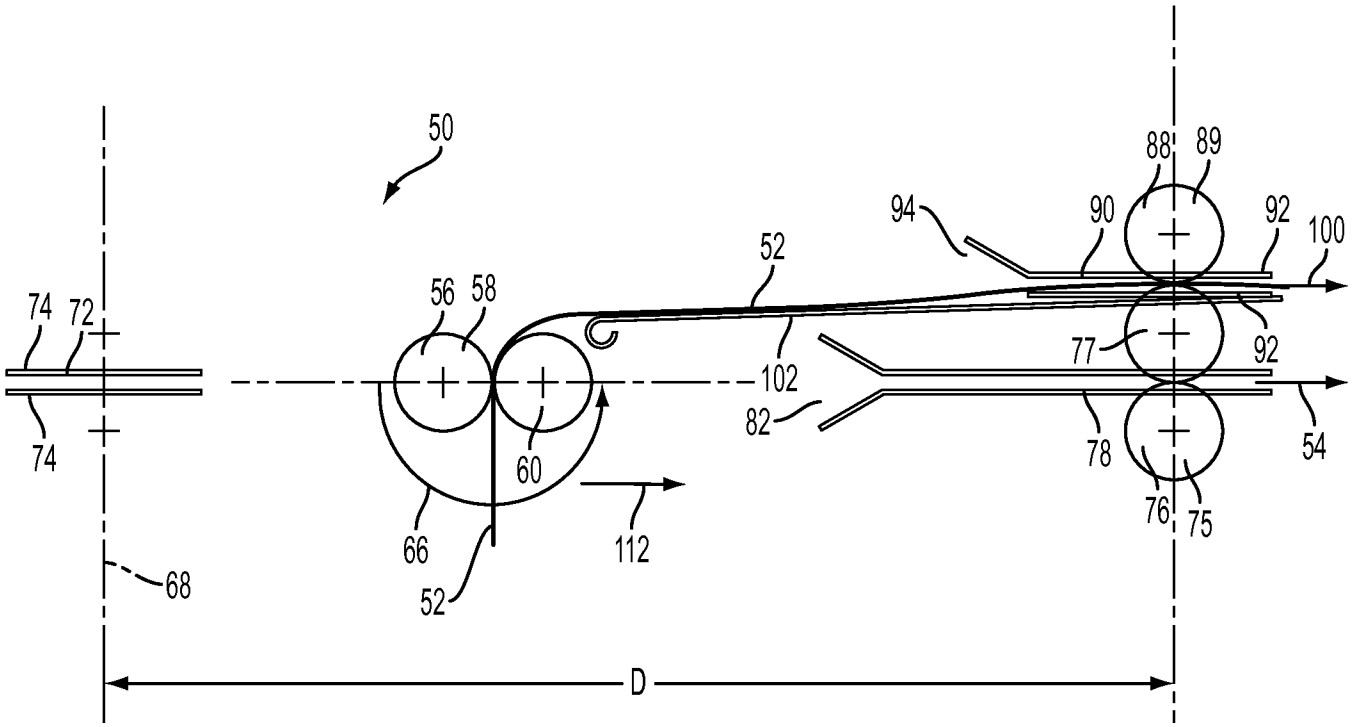
FIG. 6 is a schematic side elevational, sectional view of the shuttling nip set of FIG. 3, showing the shuttling nip set revolving in duplex operation.
Figure 7:
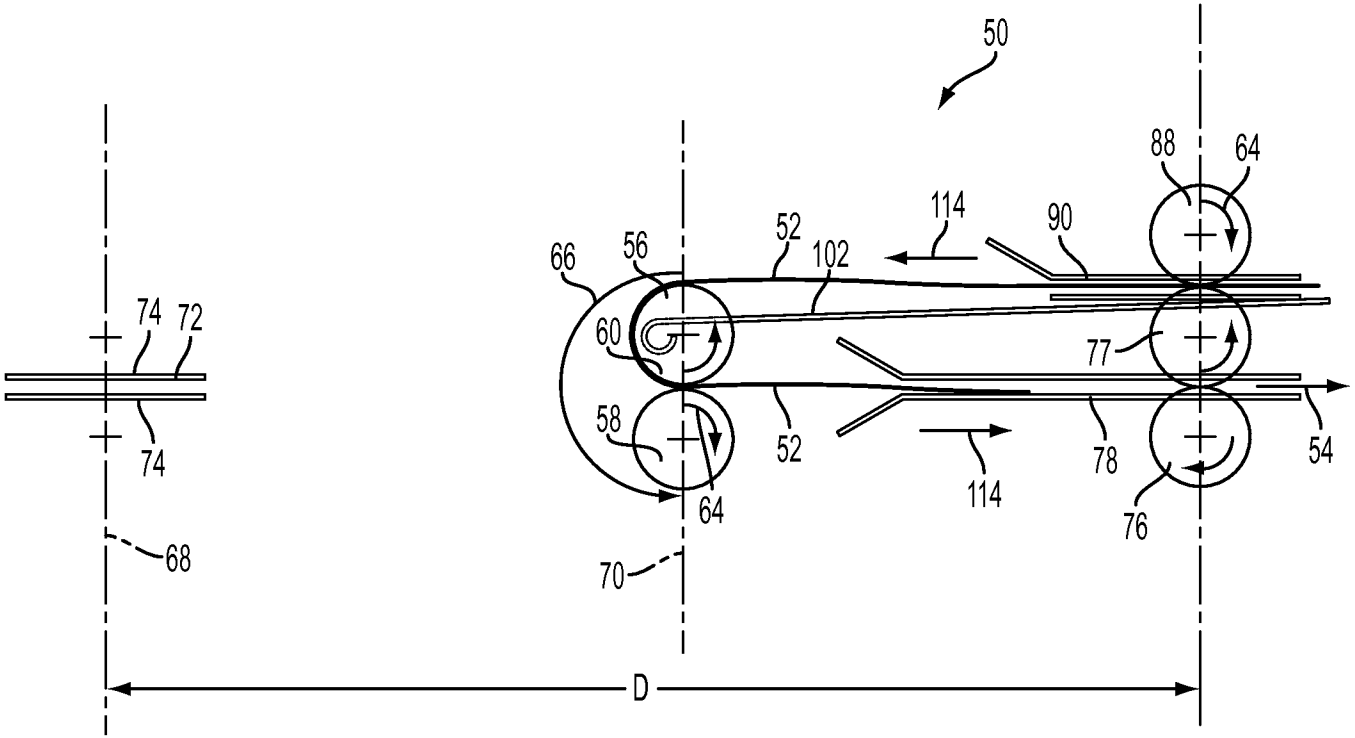
FIG. 7 is a schematic side elevational, sectional view of the shuttling nip set of FIG. 3, showing the shuttling nip set in final position, and the sheet entering the main sheet path in duplex operation.
Figure 8:
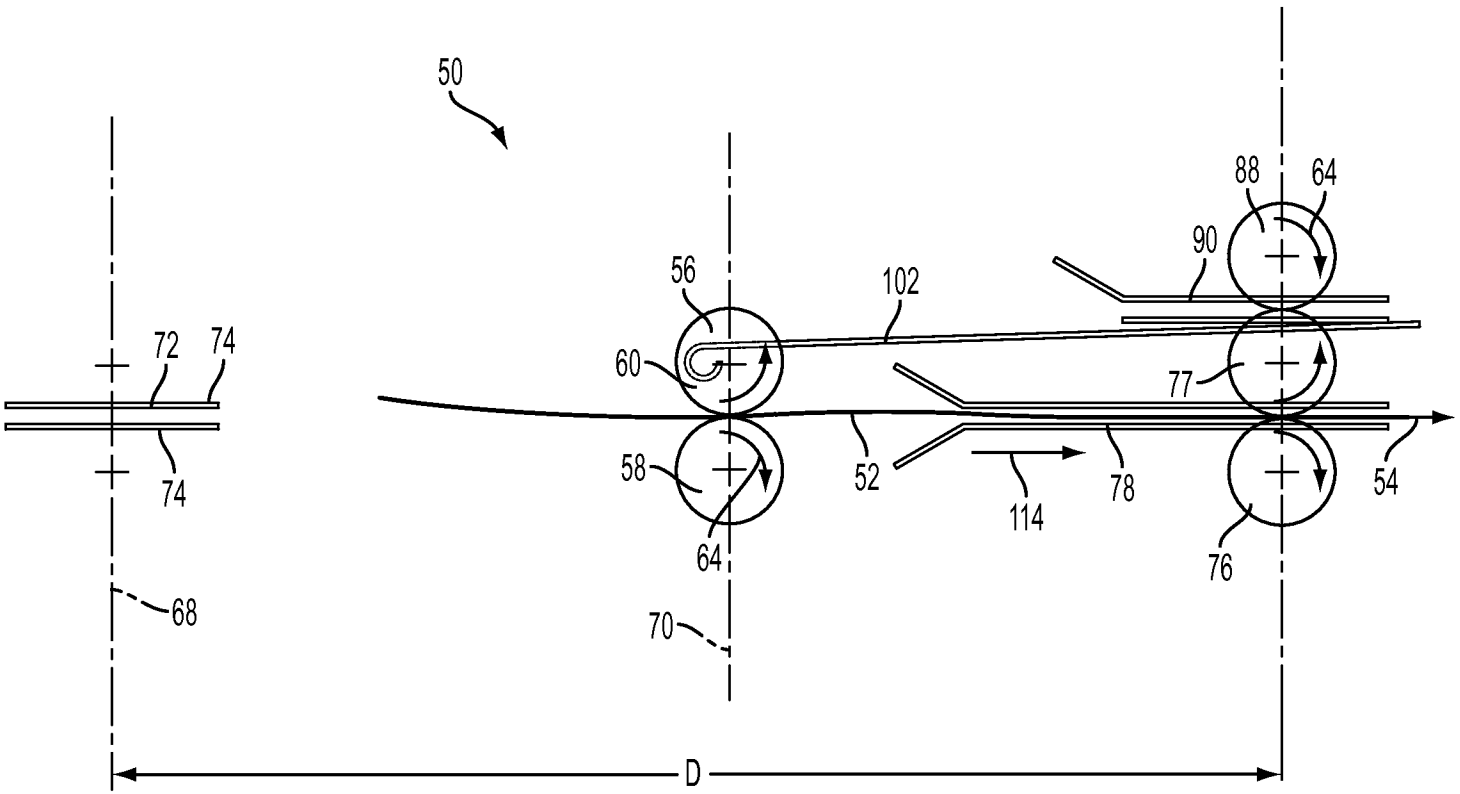
FIG. 8 is a schematic side elevational, sectional view of the shuttling nip set of FIG. 3, showing the sheet inverted on the main sheet path.
Figure 9:
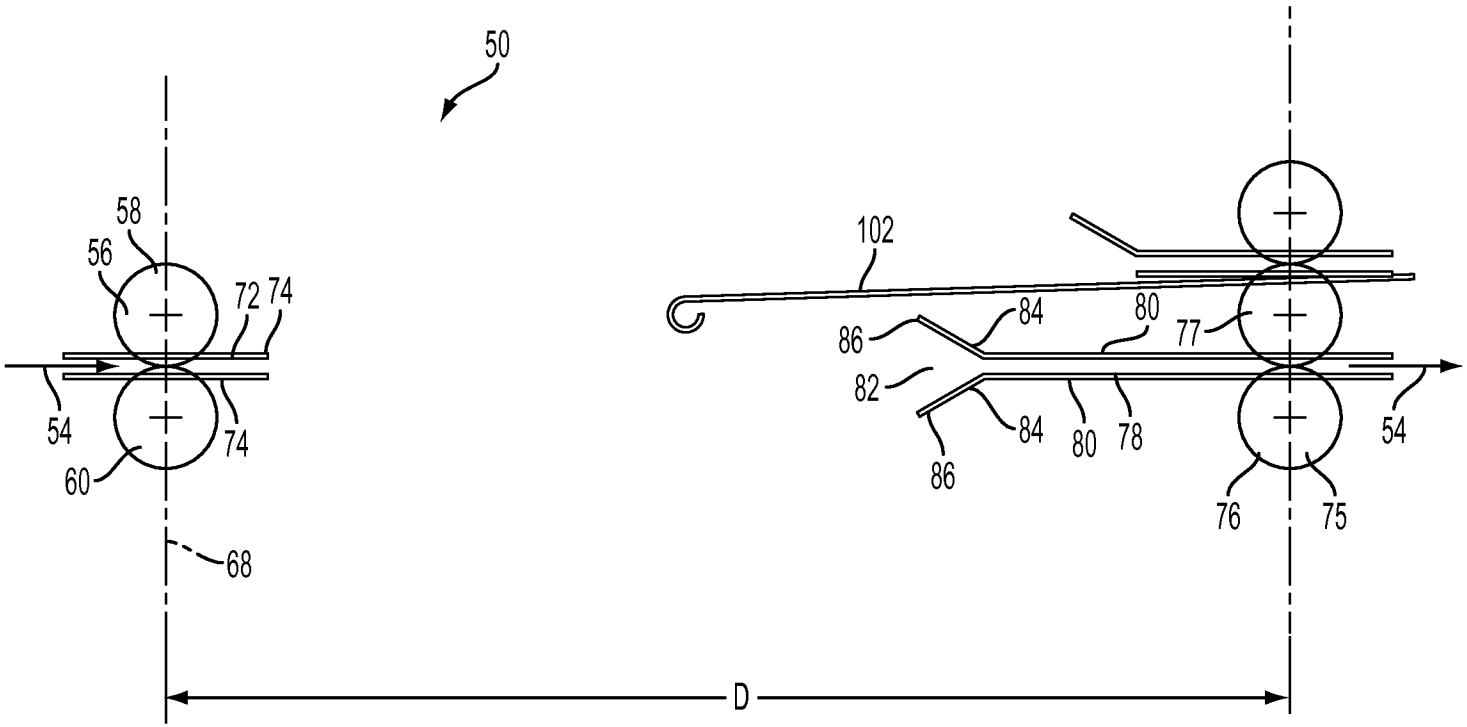
FIG. 9 is a schematic side elevational, sectional view of the shuttling nip set of FIG. 3, showing the diverter gate in simplex position.
Figure 10:
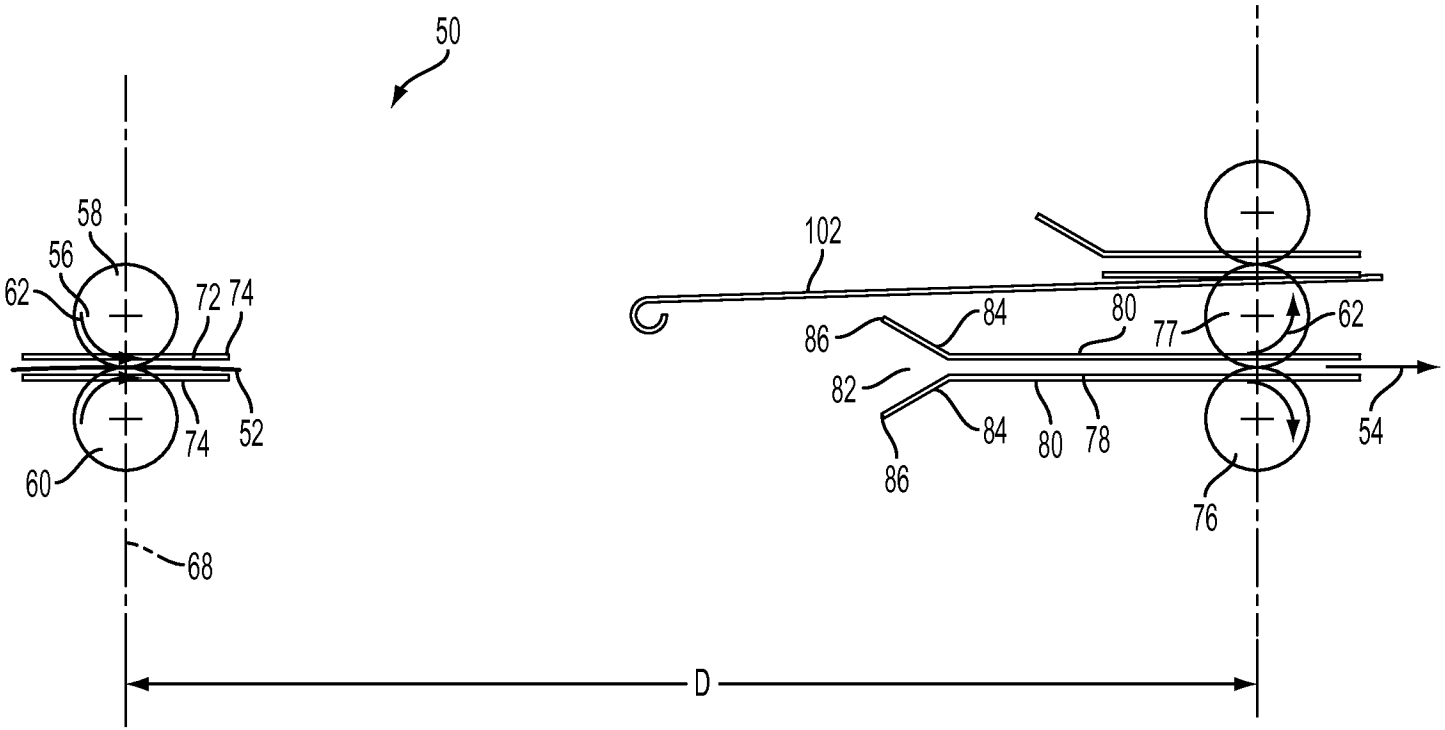
FIG. 10 is a schematic side elevational, sectional view of the shuttling nip set of FIG. 3, showing a sheet entering the shuttling nip set in simplex operation.
Figure 11:
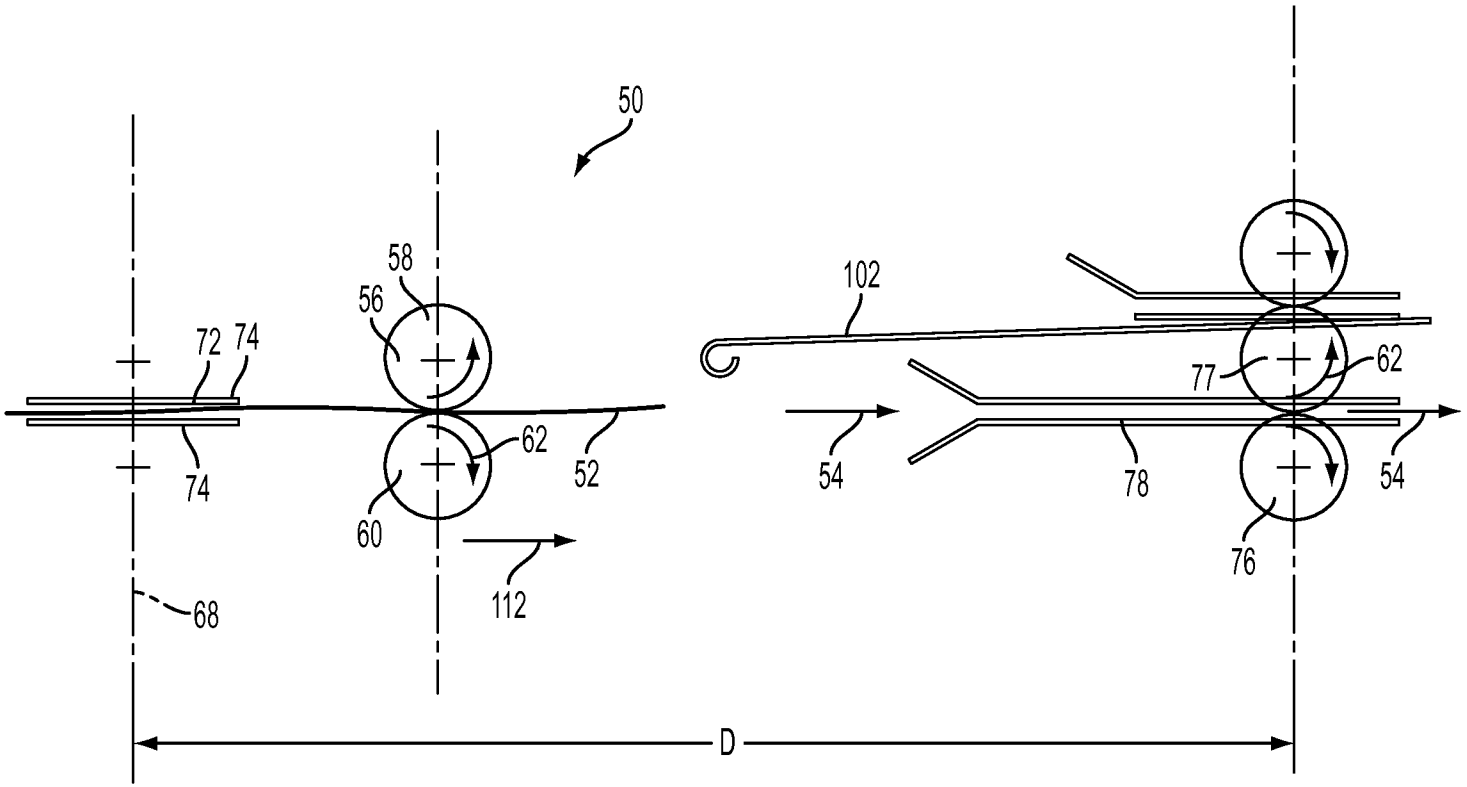
FIG. 11 is a schematic side elevational, sectional view of the shuttling nip set of FIG. 3, showing the shuttling nip set moving downstream in simplex operation.
Figure 12:
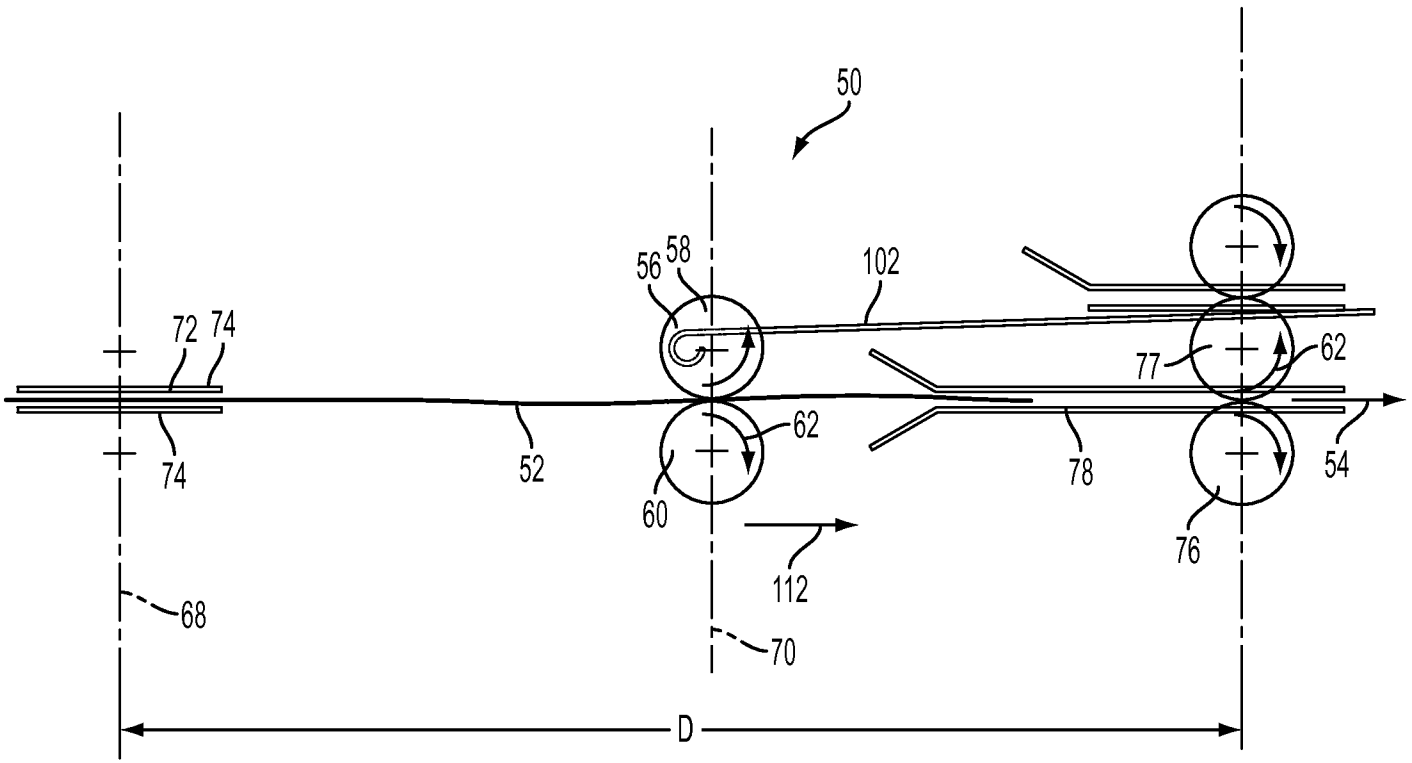
FIG. 12 is a schematic side elevational, sectional view of the shuttling nip set of FIG. 3, showing the sheet lead edge entering the main sheet path in simplex operation.
Figure 13:
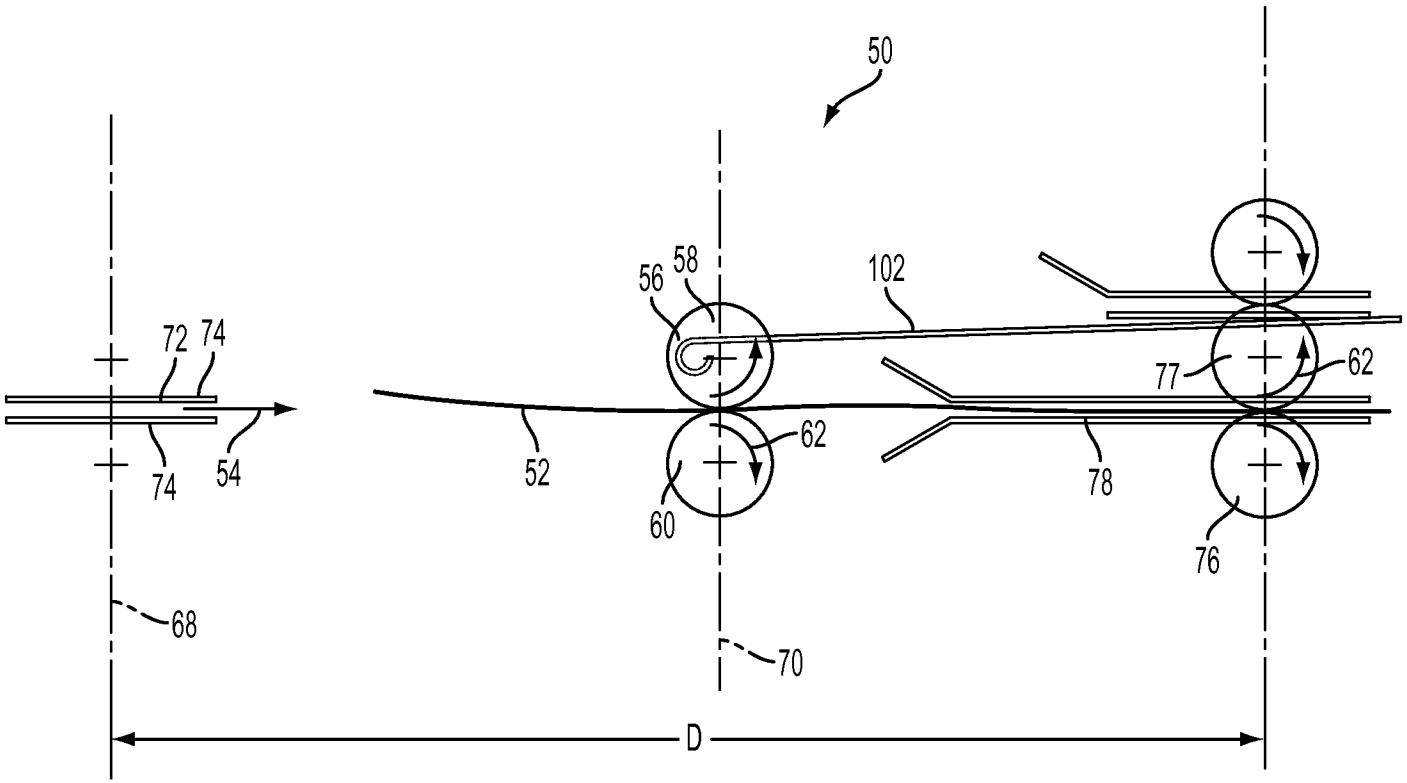
FIG. 13 is a schematic side elevational, sectional view of the shuttling nip set of FIG. 3, showing the shuttling nip set in final position in simplex operation.

Referring to FIGS. 1-8, a shuttling nip set sheet inverter 50 is for use in connection with a digital printing system 20 and a media sheet 52 moving along a process path 54 in a process direction (from left to right in the drawings). The shuttling nip set sheet inverter 50 comprises a shuttle nip 56 having a first shuttle nip roller 58 and a second shuttle nip roller 60 held in mutual engagement. The first 58 and second 60 shuttle nip rollers are adapted for selective rotation in a forward direction shown by arrows 62, and in a reverse direction shown by arrows 64. The first 58 and second 60 shuttle nip rollers are mounted for mutual revolving orbit about an orbital axis shown by arrows 66. The first 58 and second 60 shuttle nip rollers are mounted for mutual generally translational movement in the process direction from a starting position 68 to an ending position 70. The translational movement is shown by arrow 112 in FIG. 5. An entry guide 72 is aligned with the shuttle nip 56 to guide the media sheet 52 along the process path 54 to the shuttle nip 56. The entry guide 72 has an opposed pair of entry guide plates 74 spaced apart on opposite sides of the process path 54.

A main nip 76 is spaced apart from the starting position 68 of the shuttle nip 56 a predetermined distance D in the process direction. A main guide 78 is aligned with the main nip and generally aligned with the entry guide 72 in the process direction. The main guide 78 is provided to guide the media sheet 52 along the process path 54 to the main nip 76. The main guide 78 has an opposed pair of main guide plates 80 spaced apart on opposite sides of the process path 54. The main guide 78 is generally collinear with the entry guide 72. The main nip 76 has a main nip roller 75 and an intermediate nip roller 77 held in mutual rotating engagement.

A main funnel 82 is provided having two main funnel plates 84. Each funnel plate 84 is attached to an end of one of the main guide plates 80. The two funnel plates 84 have upstream ends 86 diverging away from one another to guide the media sheet 52 into the main guide 78.

An inversion nip 88 is provided adjacent the main nip 76. The inversion nip 88 is adapted for selective rotation in a forward direction and in a reverse direction. An inversion guide 90 is aligned with the inversion nip 88 and disposed adjacent the main guide 78. The inversion guide 90 is provided to guide the media sheet 52 along an inversion path 100 to the inversion nip 88. The inversion guide 90 has an opposed pair of inversion guide plates 92 spaced apart on opposite sides of the inversion path 100. The inversion guide 90 is generally parallel to the main guide 78. The inversion nip 88 has an inversion nip roller 89 which is held in mutual rotating engagement with the intermediate nip roller 77.

An inversion funnel 94 is provided having at least one inversion funnel plate 96 attached to an end of one of the inversion guide plates 92. The funnel plate 92 has an upstream end 98 diverging away from the opposite inversion guide plate to guide the media sheet 52 into the inversion guide 90.

A diverter gate 102 extends between opposite first 104 and second 106 ends. The media sheet 52 slides up the diverter gate 102 as shown by arrow 108 in FIG. 5. The diverter gate 102 is adapted for movement from an inversion position shown in FIG. 3, to a storage position shown in FIGS. 7-8. This movement upward and downstream is shown by arrow 110 in FIG. 5. In the inversion position the first end 104 is juxtaposed with the process path 54 adjacent the shuttle nip 56 and the second end 106 is juxtaposed with the inversion path 100 adjacent the inversion nip 88. The storage position is away from the process path 54. Typically, the storage position will be above the inversion position, between the main guide 78 and the inversion guide 90.

In duplex operation, the media sheet lead edge will pass through the shuttle nip 56 and travel up the diverter gate 102 into the inversion nip 88. The shuttle nip 56 will revolve orbitally and translate downstream. The shuttle nip 56 and the main nip 76 will reverse rotation. The trail edge will become the lead edge, thereby inverting the media sheet 52. The media sheet 52 will then enter the main guide 78 and pass through the main nip 76. The direction of the media sheet 52 after inversion is shown by arrows 114 in FIGS. 7-8.

A method is disclosed for inverting a media sheet. The method comprises feeding the media sheet 52 into a shuttle nip 56 having a first shuttle nip roller 58 and a second shuttle nip roller 60. The first 58 and second 60 shuttle nip rollers are rotated in a forward direction.

A lead edge of the media sheet 52 is guided along a diverter gate 102 into an inversion nip 88. The inversion nip 88 is rotated in a forward direction. The diverter gate 102 is moved to a storage position away from the process path 54.

The first 58 and second 60 shuttle nip rollers revolve mutually about an orbital axis. A trail edge of the media sheet 52 is redirected into a downstream direction toward a main nip 76. The rotation of the shuttle nip 56 is then reversed. The trail edge is allowed to become a new lead edge, thereby inverting the media sheet 52.

The first 58 and second 60 shuttle nip rollers translate mutually in a generally downstream process direction from a starting position 68 to an ending position 70. The inversion nip 88 is rotated in a reverse direction. The media sheet 52 is then guided into the main nip 76 for duplex operation.

An entry guide 72 is provided for guiding the media sheet 52 along the process path 54 to the shuttle nip 56. The entry guide 72 is aligned with the shuttle nip 56. A main guide 78 is provided for guiding the media sheet 52 along the process path 54 to the main nip 76. The main guide 78 is aligned with the main nip 76. The entry guide 72 is aligned generally with the main guide 78 in the process direction.

An inversion nip 88 is provided adjacent the main nip 76. An inversion guide 90 is provided for guiding the media sheet 52 along an inversion path 100 to the inversion nip 88. The inversion guide 90 is aligned with the inversion nip 88.

A main funnel 82 is provided having two main funnel plates 84. Each main funnel plate 84 is attached to an end of one of two main guide plates 80. The upstream ends 86 of the two main funnel plates 84 diverge away from one another. The main funnel 82 is for guiding the media sheet 52 into the main guide 78.

An inversion funnel 94 is provided having at least one inversion funnel plate 96. The inversion funnel plate 96 is attached to an end of one of two inversion guide plates 92. An upstream end 98 of the inversion funnel plate 96 diverges away from the opposite inversion guide plate 92. The media sheet 52 is guided into the inversion guide 90 with the inversion funnel 94. The main guide 78 is aligned generally collinear with the entry guide 72. The inversion guide 90 is aligned generally parallel to the main guide 78.

The main nip 76 is provided with a main nip roller 75 and an intermediate nip roller 77. The main nip roller 75 and the intermediate nip roller 77 are held in mutual rotating engagement. The inversion nip 88 is provided with an inversion nip roller 89. The inversion nip roller 89 and the intermediate nip roller 77 are held in mutual rotating engagement. The first shuttle nip roller 58 and the second shuttle nip roller 60 are held in mutual rotating engagement.

The diverter gate 102 is disposed in an inversion position with a first end 104 juxtaposed with the process path 54 adjacent the entry guide 72. A second end 106 is juxtaposed with the inversion path 100 adjacent the inversion guide 90. The diverter gate moves from the inversion position to the storage position between the inversion path 100 and the process path 54.

In the case of simplex printing, the method comprises feeding the media sheet 52 into a shuttle nip 56 having a first shuttle nip roller 58 and a second shuttle nip roller 60. The first 58 and second 60 shuttle nip rollers are rotated in a forward direction. The first 58 and second 60 shuttle nip rollers translate mutually in a generally downstream process direction from a starting position 68 to an ending position 70. The media sheet 52 is guided into the main nip 76 for simplex operation.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A shuttling nip set sheet inverter for use in connection with a digital printing system and a media sheet moving along a process path in a process direction, the shuttling nip set sheet inverter comprising:

a shuttle nip having a first shuttle nip roller and a second shuttle nip roller, the first and second shuttle nip rollers being adapted for selective rotation in a forward direction and in a reverse direction, the first and second shuttle nip rollers being mounted for mutual revolving orbit about an orbital axis, the first and second shuttle nip rollers being mounted for mutual generally translational movement in the process direction from a starting position to an ending position;

a main nip spaced apart from the shuttle nip a predetermined distance in the process direction;

an inversion nip adjacent the main nip;

a diverter gate extending between opposite first and second ends, the diverter gate being adapted for movement from an inversion position with the first end adjacent the shuttle nip and the second end adjacent the inversion nip, to a storage position away from the process path;

so that in duplex operation, the media sheet lead edge will pass through the shuttle nip, the shuttle nip will revolve orbitally and translate downstream, and the trail edge will become the lead edge, inverting the media sheet.

2. The shuttling nip set sheet inverter of claim 1, further comprising:

an entry guide aligned with the shuttle nip to guide the media sheet along the process path to the shuttle nip, the entry guide having an opposed pair of entry guide plates spaced apart on opposite sides of the process path;

a main guide aligned with the main nip and generally aligned with the entry guide in the process direction to guide the media sheet along the process path to the main nip, the main guide having an opposed pair of main guide plates spaced apart on opposite sides of the process path; and an inversion guide aligned with the inversion nip and adjacent the main guide to guide the media sheet along an inversion path to the inversion nip, the inversion guide having an opposed pair of inversion guide plates spaced apart on opposite sides of the inversion path.

3. The shuttling nip set sheet inverter of claim 2, further comprising:

a main funnel having two funnel plates, each funnel plate being attached to an end of one of the main guide plates, the two funnel plates having upstream ends diverging away from one another to guide the media sheet into the main guide; and an inversion funnel having at least one funnel plate attached to an end of one of the inversion guide plates, the funnel plate having an upstream end diverging away from the opposite inversion guide plate to guide the media sheet into the inversion guide.

4. The shuttling nip set sheet inverter of claim 2, further comprising:

the main guide being generally collinear with the entry guide; and the inversion guide being generally parallel to the main guide.

5. The shuttling nip set sheet inverter of claim 1, further comprising:

an intermediate nip roller;

the main nip having a main nip roller, the main nip roller and the intermediate nip roller being held in mutual rotating engagement;

the inversion nip having an inversion nip roller, the inversion nip roller and the intermediate nip roller being held in mutual rotating engagement, the inversion nip being adapted for selective rotation in a forward direction and in a reverse direction; and the first shuttle nip roller and the second shuttle nip roller being held in mutual rotating engagement.

6. A shuttling nip set sheet inverter for use in connection with a digital printing system and a media sheet moving along a process path in a process direction, the shuttling nip set sheet inverter comprising:

a shuttle nip having a first shuttle nip roller and a second shuttle nip roller, the first and second shuttle nip rollers being adapted for selective rotation in a forward direction and in a reverse direction, the first and second shuttle nip rollers being mounted for mutual revolving orbit about an orbital axis, the first and second shuttle nip rollers being mounted for mutual generally translational movement in the process direction from a starting position to an ending position;

an entry guide aligned with the shuttle nip to guide the media sheet along the process path to the shuttle nip;

a main nip spaced apart from the shuttle nip a predetermined distance in the process direction;

a main guide aligned with the main nip and generally aligned with the entry guide in the process direction to guide the media sheet along the process path to the main nip;

an inversion nip adjacent the main nip, the inversion nip being adapted for selective rotation in a forward direction and in a reverse direction;

an inversion guide aligned with the inversion nip and adjacent the main guide to guide the media sheet along an inversion path to the inversion nip;

a diverter gate extending between opposite first and second ends, the diverter gate being adapted for movement from an inversion position with the first end juxtaposed with the process path adjacent the shuttle nip and the second end juxtaposed with the inversion path adjacent the inversion nip, to a storage position away from the process path; so that in duplex operation, the media sheet lead edge will pass through the shuttle nip and travel up the diverter gate into the inversion nip, the shuttle nip will revolve orbitally and translate downstream, the shuttle nip and the main nip will reverse rotation, the trail edge will become the lead edge thereby inverting the media sheet, and the media sheet will enter the main guide and pass through the main nip.

7. The shuttling nip set sheet inverter of claim 6, further comprising:

the entry guide having an opposed pair of entry guide plates spaced apart on opposite sides of the process path;

the main guide having an opposed pair of main guide plates spaced apart on opposite sides of the process path; and the inversion guide having an opposed pair of inversion guide plates spaced apart on opposite sides of the inversion path.

8. The shuttling nip set sheet inverter of claim 7, further comprising:

a main funnel having two funnel plates, each funnel plate being attached to an end of one of the main guide plates, the two funnel plates having upstream ends diverging away from one another to guide the media sheet into the main guide; and an inversion funnel having at least one funnel plate attached to an end of one of the inversion guide plates, the funnel plate having an upstream end diverging away from the opposite inversion guide plate to guide the media sheet into the inversion guide.

9. The shuttling nip set sheet inverter of claim 7, further comprising:

the main guide being generally collinear with the entry guide; and the inversion guide being generally parallel to the main guide.

10. The shuttling nip set sheet inverter of claim 6, further comprising:

an intermediate nip roller;

the main nip having a main nip roller, the main nip roller and the intermediate nip roller being held in mutual rotating engagement;

the inversion nip having an inversion nip roller, the inversion nip roller and the intermediate nip roller being held in mutual rotating engagement; and the first shuttle nip roller and the second shuttle nip roller being held in mutual rotating engagement.

11. A shuttling nip set sheet inverter for use in connection with a digital printing system and a media sheet moving along a process path in a process direction, the shuttling nip set sheet inverter comprising:

a shuttle nip having a first shuttle nip roller and a second shuttle nip roller, the first and second shuttle nip rollers being adapted for selective rotation in a forward direction and in a reverse direction, the first and second shuttle nip rollers being mounted for mutual revolving orbit about an orbital axis, the first and second shuttle nip rollers being mounted for mutual generally translational movement in the process direction from a starting position to an ending position;

an entry guide aligned with the shuttle nip to guide the media sheet along the process path to the shuttle nip, the entry guide having an opposed pair of entry guide plates spaced apart on opposite sides of the process path;

a main nip spaced apart from the shuttle nip a predetermined distance in the process direction;

a main guide aligned with the main nip and generally aligned with the entry guide in the process direction to guide the media sheet along the process path to the main nip, the main guide having an opposed pair of main guide plates spaced apart on opposite sides of the process path;

a main funnel having two funnel plates, each funnel plate being attached to an end of one of the main guide plates, the two funnel plates having upstream ends diverging away from one another to guide the media sheet into the main guide;

an inversion nip adjacent the main nip, the inversion nip being adapted for selective rotation in a forward direction and in a reverse direction;

an inversion guide aligned with the inversion nip and adjacent the main guide to guide the media sheet along an inversion path to the inversion nip, the inversion guide having an opposed pair of inversion guide plates spaced apart on opposite sides of the inversion path;

an inversion funnel having at least one funnel plate attached to an end of one of the inversion guide plates, the funnel plate having an upstream end diverging away from the opposite inversion guide plate to guide the media sheet into the inversion guide;

a diverter gate extending between opposite first and second ends, the diverter gate being adapted for movement from an inversion position with the first end juxtaposed with the process path adjacent the shuttle nip and the second end juxtaposed with the inversion path adjacent the inversion nip, to a storage position away from the process path;

so that in duplex operation, the media sheet lead edge will pass through the shuttle nip and travel up the diverter gate into the inversion nip, the shuttle nip will revolve orbitally and translate downstream, the shuttle nip and the main nip will reverse rotation, the trail edge will become the lead edge thereby inverting the media sheet, and the media sheet will enter the main guide and pass through the main nip.

12. The shuttling nip set sheet inverter of claim 11, further comprising:

the main guide being generally collinear with the entry guide; and the inversion guide being generally parallel to the main guide.

13. The shuttling nip set sheet inverter of claim 11, further comprising:

an intermediate nip roller;

the main nip having a main nip roller, the main nip roller and the intermediate nip roller being held in mutual rotating engagement;

the inversion nip having an inversion nip roller, the inversion nip roller and the intermediate nip roller being held in mutual rotating engagement; and the first shuttle nip roller and the second shuttle nip roller being held in mutual rotating engagement.

14. A method for inverting a media sheet for use in connection with a digital printing system and a media sheet, the method comprising:

feeding the media sheet into a shuttle nip having a first shuttle nip roller and a second shuttle nip roller;

rotating the first and second shuttle nip rollers in a forward direction;

guiding a lead edge of the media sheet along a diverter gate into an inversion nip;

rotating the inversion nip in a forward direction;

moving the diverter gate to a storage position away from the process path;

revolving the first and second shuttle nip rollers mutually about an orbital axis;

redirecting a trail edge of the media sheet into a downstream direction toward a main nip;

reversing rotation of the shuttle nip;

allowing the trail edge to become a new lead edge, thereby inverting the media sheet;

translating the first and second shuttle nip rollers mutually in a generally downstream process direction from a starting position to an ending position;

rotating the inversion nip in a reverse direction; and guiding the media sheet into the main nip for duplex operation.

15. The method of claim 14, further comprising:

providing an entry guide and aligning the entry guide with the shuttle nip for guiding the media sheet along the process path to the shuttle nip;

providing a main guide and aligning the main guide with the main nip for guiding the media sheet along the process path to the main nip;

aligning the entry guide generally with the main guide in the process direction;

providing an inversion nip adjacent the main nip; and providing an inversion guide and aligning the inversion guide with the inversion nip for guiding the media sheet along an inversion path to the inversion nip.

16. The method of claim 15, further comprising:

providing a main funnel with two main funnel plates, and attaching each main funnel plate to an end of one of two main guide plates;

diverging upstream ends of the two main funnel plates away from one another and guiding the media sheet into the main guide with the main funnel;

providing an inversion funnel with at least one inversion funnel plate and attaching the inversion funnel plate to an end of one of two inversion guide plates; and diverging an upstream end of the inversion funnel plate away from the opposite inversion guide plate and guiding the media sheet into the inversion guide with the inversion funnel.

17. The method of claim 16, further comprising:

aligning the main guide generally collinear with the entry guide; and aligning the inversion guide generally parallel to the main guide.

18. The method of claim 14, further comprising:

providing the main nip with a main nip roller and an intermediate nip roller, and holding the main nip roller and the intermediate nip roller in mutual rotating engagement;

providing the inversion nip with an inversion nip roller and holding the inversion nip roller and the intermediate nip roller in mutual rotating engagement; and holding the first shuttle nip roller and the second shuttle nip roller in mutual rotating engagement.

19. The method of claim 14, further comprising:

disposing the diverter gate in an inversion position with a first end juxtaposed with the process path adjacent the entry guide and a second end juxtaposed with the inversion path adjacent the inversion guide; and moving the diverter gate from the inversion position to the storage position between the inversion path and the process path.

* * * * *